US006956535B2

(12) United States Patent
Hart

(10) Patent No.: US 6,956,535 B2
(45) Date of Patent: Oct. 18, 2005

(54) COAXIAL INDUCTOR AND DIPOLE EH ANTENNA

(76) Inventor: Robert T. Hart, 814 Madison Rd., Eatonton, GA (US) 31024

( * ) Notice: Subject to any disclaimer, the term of this patent is extended or adjusted under 35 U.S.C. 154(b) by 0 days.

(21) Appl. No.: 10/610,038

(22) Filed: Jun. 30, 2003

(65) Prior Publication Data

US 2004/0263409 A1 Dec. 30, 2004

(51) Int. Cl.[7] ..... H01Q 9/16
(52) U.S. Cl. ..... 343/792
(58) Field of Search ..... 343/810, 867, 343/725, 793, 726, 727, 728, 729

(56) References Cited

U.S. PATENT DOCUMENTS

| | | | | |
|---|---|---|---|---|
| 3,159,838 A | | 12/1964 | Facchine | |
| 3,475,687 A | | 10/1969 | Pierce | |
| 3,521,284 A | | 7/1970 | Shelton et al. | |
| 3,829,863 A | | 8/1974 | Lipsky | |
| 4,003,056 A | | 1/1977 | Davis | |
| 4,183,027 A | | 1/1980 | Ehrenspeck | |
| 4,187,507 A | | 2/1980 | Crane et al. | |
| 4,360,813 A | * | 11/1982 | Fitzsimmons | 342/350 |
| 4,388,625 A | | 6/1983 | Schwartz | |
| 4,809,009 A | | 2/1989 | Grimes et al. | |
| 5,142,255 A | * | 8/1992 | Chang et al. | 333/204 |
| 5,155,495 A | | 10/1992 | Hately et al. | |
| 5,231,346 A | | 7/1993 | Gassmann | |
| 5,278,571 A | * | 1/1994 | Helfrick | 343/703 |
| 5,304,998 A | | 4/1994 | Lopez | |
| 5,495,259 A | | 2/1996 | Lyasko | |
| 5,534,880 A | | 7/1996 | Button et al. | |
| 5,557,293 A | * | 9/1996 | McCoy et al. | 343/867 |
| 5,760,747 A | | 6/1998 | McCoy et al. | |
| 5,892,485 A | | 4/1999 | Glabe et al. | |
| 6,025,813 A | | 2/2000 | Hately et al. | |
| 6,091,371 A | * | 7/2000 | Buer et al. | 343/754 |
| 6,304,230 B1 | * | 10/2001 | Panther et al. | 343/867 |
| 6,700,549 B2 | * | 3/2004 | Holzman | 343/772 |

FOREIGN PATENT DOCUMENTS

| | | |
|---|---|---|
| GB | 1284727 | 8/1972 |

* cited by examiner

*Primary Examiner*—Wilson Lee
*Assistant Examiner*—Huedung X. Cao
(74) *Attorney, Agent, or Firm*—Bryan W. Bockhop; Bockhop & Associates, LLC

(57) ABSTRACT

An antenna for generating radiation includes a primary E-field generating circuit and a secondary E-field generating circuit. The primary E-field generating circuit generates a primary E-field in response to a source RF signal being applied to the antenna. The secondary E-field generating circuit generates a secondary E-Field, disposed apart from the primary E-field, in response to the source RF signal and develops an H-field that is in time phase with the primary E-field. This causes the antenna to develop a radiation resistance as an indication of radiation.

15 Claims, 4 Drawing Sheets

COAXIAL INDUCTOR AND DIPOLE EH ANTENNA

BACKGROUND OF THE INVENTION

1. Field of the Invention

The present invention relates to radio frequency communications and, more specifically, to an antenna system employed in radio frequency communications.

2. Description of the Prior Art

Radio signals usually start with electrical signals that have been modulated onto a radio frequency carrier wave. The resulting radio signal is transmitted using an antenna. The antenna is a system that generates an electrical field (E field) and a magnetic field (H field) that vary in correspondence with the radio signal, thereby forming radio frequency radiation. At a distance from the antenna, as a result of transmission effects of the medium through which the radio frequency radiation is being transmitted, the E field and the H field fall into phase with each other, thereby generating a Poynting vector, which is given by $S=E\times H$, where S is the Poynting vector, E is the E field vector and H is the H field vector.

Conventional Hertz antenna systems are resonant systems that take the form of wire dipoles or ground plane antennas that run electrically in parallel to the output circuitry of radio frequency transmitters and receivers. Such antenna systems require, for maximum performance, that the length of each wire of the dipole, or the radiator or the ground plane be one fourth of the wavelength of the radiation being transmitted or received. For example, if the wavelength of the radiation is 1000 ft., the length of the wire must be 250 ft. Thus, the typical wire antenna requires a substantial amount of space as a function of the wavelength being transmitted and received.

A Crossed Field Antenna, as disclosed in U.S. Pat. No. 6,025,813, employs two separate sections which independently develop the E and H fields and are configured to allow combining the E and H fields to generate radio frequency radiation. The result is that the antenna is not a resonant structure, thus a single structure may be used over a wide frequency range. The Crossed Field Antenna is small, relative to wavelength (typically 1% to 3% of wavelength) and provides high efficiency. The Crossed Field Antenna has the disadvantage of requiring a complicated physical structure to develop the E and H fields in separate sections of the antenna. The Crossed Field Antenna also requires an associated complex matching/phasing network to feed the antenna.

SUMMARY OF THE INVENTION

The disadvantages of the prior art are overcome by the present invention which, in one aspect is an antenna for generating radiation that includes a primary E-field generating circuit and a secondary E-field generating circuit. The primary E-field generating circuit generates a primary E-field in response to a source RF signal being applied to the antenna. The secondary E-field generating circuit generates a secondary E-Field, disposed apart from the primary E-field, in response to the source RF signal and develops an H-field that is in time phase with the primary E-field. This causes the antenna to develop a radiation resistance as an indication of radiation.

In another aspect, the invention is an antenna system, for use with a signal cable having a signal lead and a common lead. The antenna system includes a first elongated dipole element and a second elongated dipole element that is coupled to the common lead and spaced apart from the first elongated dipole element. An inductor is spaced apart from the first elongated dipole element and the second elongated dipole element, and is substantially coaxial with the first elongated dipole element and the second elongated dipole element. The inductor has an inductor proximal end and an inductor distal end. The inductor proximal end is electrically coupled to the signal lead and the inductor distal end is electrically coupled to the first elongated dipole element.

In another aspect, the invention is an antenna for use with a signal cable having a signal lead and a common lead. The antenna includes an insulating elongated support member. A first cylindrical conductor is disposed about a first portion of the support member. The first cylindrical conductor has a proximal end and an opposite distal end. A second cylindrical conductor is disposed about a second portion of the support member and is spaced apart from the first cylindrical member. The second cylindrical conductor has a proximal end and an opposite distal end. The proximal end is in electrical communication with the common lead. A conductive coil is coiled about the elongated support member and is spaced apart from and substantially coaxial with the first cylindrical conductor and the second cylindrical conductor. The conductive coil has a proximal end and an opposite distal end. The proximal end is in electrical communication with the signal lead and the distal end is in electrical communication with the proximal end of the first cylindrical conductor. A moveable contact is electrically coupled to the signal lead and electrically couples the signal lead to the conductive coil. The moveable contact is capable of coupling the signal lead to the conductive coil at a selected position of the inductor so as to make the antenna tunable with respect to resonant frequency.

In yet another aspect, the invention is a communications antenna for both transmitting and receiving in association with a communications system through a feed line having a high side and a ground. The antenna includes two dipole elements that are short relative to a predetermined operating wavelength and that have a diameter so as to have a predetermined capacity therebetween. An inductance, having a source end, is disposed proximal to the two dipole elements. A first end of the inductance is electrically coupled to a first one of the two dipole elements. A second one of the two dipole elements is electrically coupled to the feed line. The high side of the feed line is connected to an end of the inductance opposite the source end, so that the predetermined capacity is resonated with an inductance and so that at a resonant frequency a large voltage forming a primary E field is developed between the two dipole elements and at the source end of the inductance a source voltage is 90 degrees delayed relative to the primary E field and so that the source voltage forms a secondary E field between the source end of the inductance and the two dipole elements and so that the secondary E field causes a displacement current to flow in a natural capacity of the space between the source end of the inductance and the dipole elements, such that the displacement current is advanced 90 degrees through the capacity so as to be in phase with the primary E field and develop a magnetic (H) field that surrounds the primary E field.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
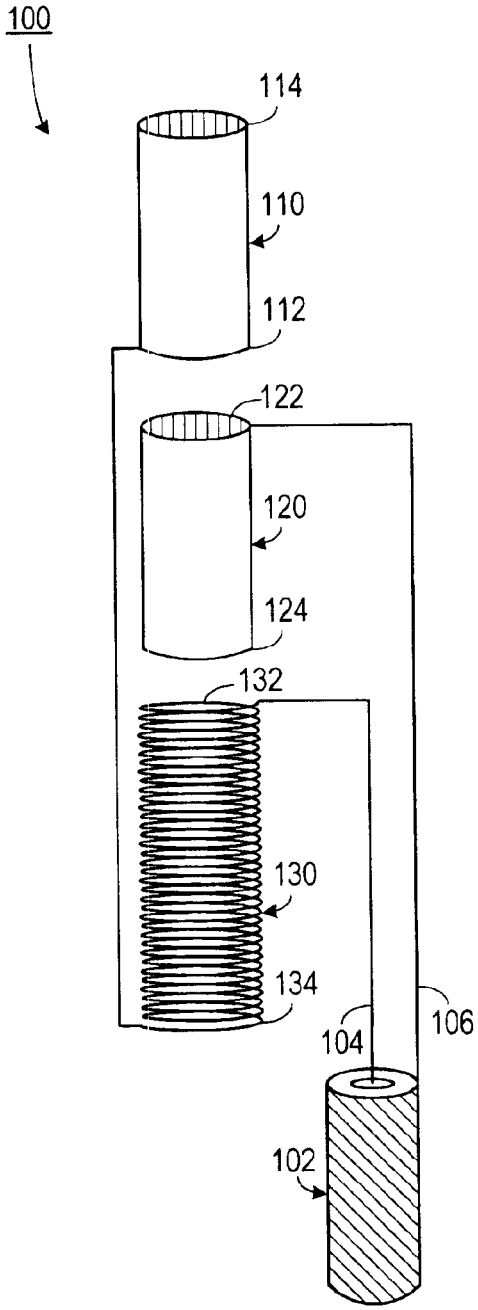
FIG. 1 is a schematic diagram of a first illustrative embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on."

A general discussion of Poynting vector theory may be found in the disclosure of U.S. Pat. Nos. 5,155,495 and 6,025,813, which are incorporated herein by reference.

The concept of the invention is based on the Poynting Theorem, where S=E×H. If an E field and an H field are developed and they have the proper relationship in amplitude, time (phase) and physical relationship, radiation will be developed.

As shown in FIG. 1, one embodiment of the invention includes an antenna 100 for use with a signal cable 102 having a signal lead 104 and a common lead 106 (also referred to as a ground lead or a reference lead). The signal cable 102 could be a feed line selected from one of many types of signal cables, including a coaxial cable, a twisted pair, a parallel wire cable or other type of balanced line.

The antenna 100 includes a first elongated dipole element 110 (such as a cylinder made of metal foil) having a proximal end 112 and an opposite distal end 114. A second elongated dipole element 120 (which could also include a cylinder made of metal foil), having a proximal end 122 and an opposite distal end 124, is coupled to the common lead 106, typically, but not necessarily, at the proximal end 122. An inductor 130 is spaced apart from the first elongated dipole element 110 and the second elongated dipole element 120. Typically, but not necessarily, the first elongated dipole element 110, the second elongated dipole element 120 and the inductor 130 are coaxial with each other. The inductor 130 has an inductor proximal end 132 and an inductor distal end 134. The inductor proximal end 132 is electrically coupled to the signal lead 104 (and thus may be referred to as the "source end"). The inductor distal end 134 is electrically coupled to the first elongated dipole element 110, typically, but not necessarily, to the proximal end 112. The inductor 130 may be placed in positions other than shown in FIG. 1, without departing from the scope of the invention.

Figure 2:
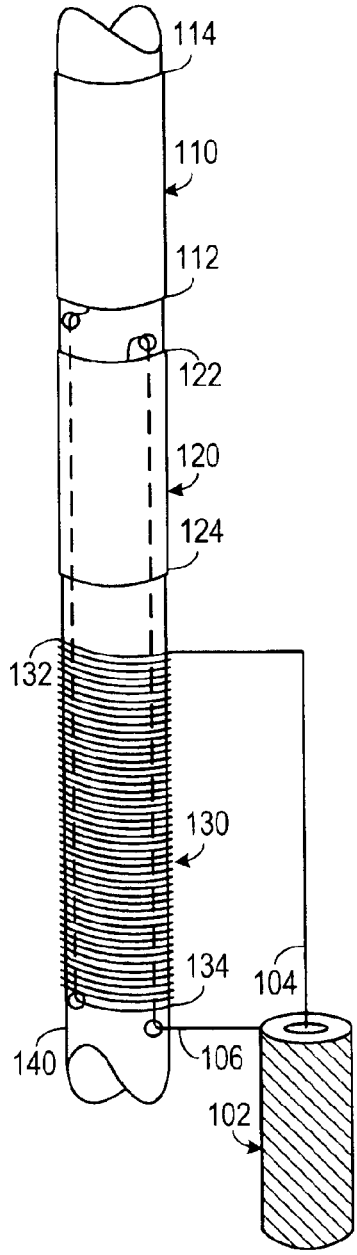
FIG. 2 is a schematic diagram of the embodiment of FIG. 1 mounted on a tube.

While the system shown in FIG. 1 does not show a particular form of support for the inductor 130 and the dipole elements 110 and 120, support could be accomplished in one of many ways. For example, in an embodiment shown in FIG. 2, the first elongated dipole element 110 and the second elongated dipole element 120 both comprise cylinders of copper (or other metal) foil wrapped about an insulating tube 140 (such as a polyvinyl chloride tube or a fiberglass tube), with the inductor 130 being a coil of wire wrapped about the tube 104. Other methods of support may also be used, including using a solid rod, suspending the elements in air and placing the elements on the inside of a cavity.

Figure 3:
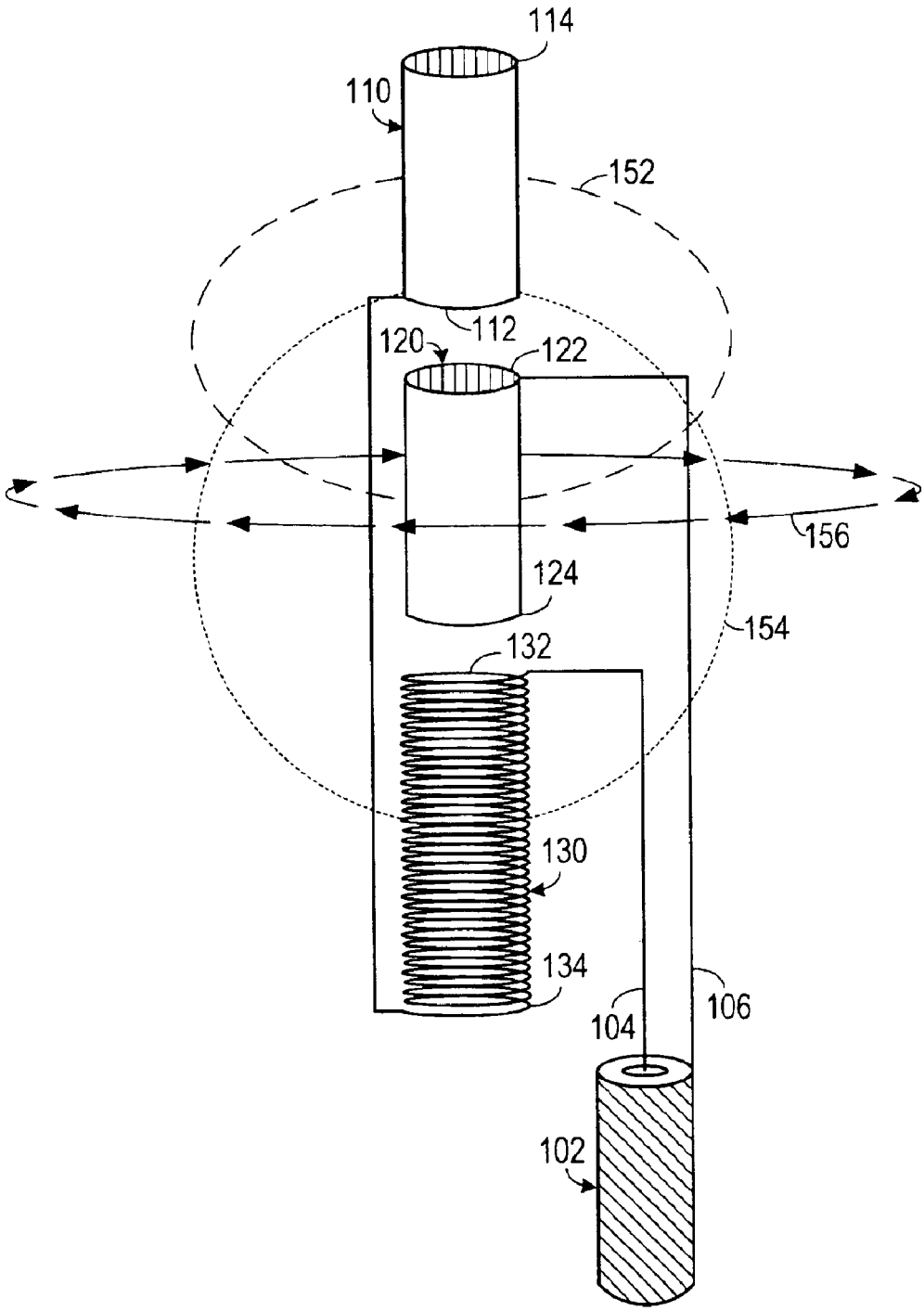
FIG. 3 is a schematic diagram of one illustrative embodiment of the invention showing the relationship between various fields generated by the antenna.

The various fields created by the system are shown in FIG. 3. When a signal is applied to the signal cable, a primary E-field 152 is created between the first elongated dipole element 110 and the second elongated dipole element 120. A secondary E-field 154 is created between the dipole elements 110 and 120 and the inductor 130. An H-field 156 is then created by the current flowing through the capacity between the components. Because the inductor 130 induces a 90° phase delay between the Primary E field 152 and the secondary E field 154, and current through the capacity caused by the secondary E field 154 is phase advanced 90 degrees, the H-field 156 resulting from that current is in nominal time phase with the primary E-field 152.

Figure 4:
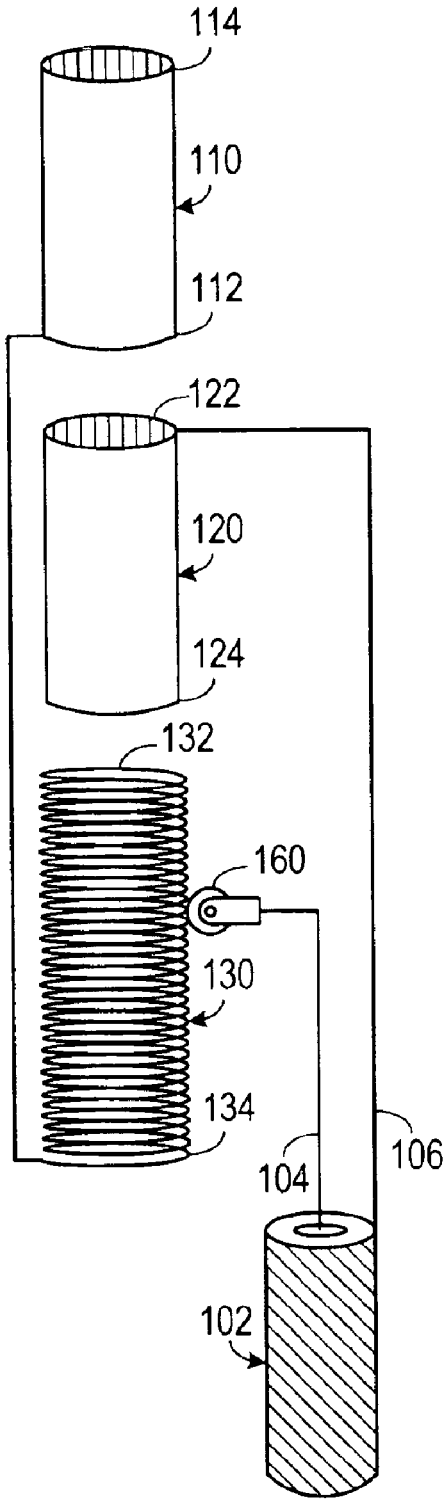
FIG. 4 is a schematic diagram of a tunable frequency embodiment of the invention.

As shown in FIG. 4, a moveable contact 160 may be used to couple the signal lead 104 to the inductor 130 to allow the antenna to be tuned to a desired resonant frequency. The moveable contact 160 could be a roller, a brush or one of many types of contacts used to vary contact position along a coil. In such a configuration, the inductor 130 can be held in a fixed position, while the moveable contact 160 is moved to a desired location on the inductor 130. Conversely, the moveable contact 160 can be held in the fixed position, while the inductor 130 is moved to achieve tuning. This embodiment allows the antenna to be tuned to many different resonant frequencies within a range defined by the inductor 130. As is clear to those skilled in the art, many different types of variable inductors or tuning circuits may be employed without departing from the scope of the invention.

When the H field of the antenna is developed as a result of displacement current, the current leads the applied voltage by 90 degrees. Because this current is the source of the H field, it is necessary to delay the applied voltage by 90 degrees so that the H-field is in phase with the primary E-field, thus the need for a delay network. Because there is a natural 90 degree phase delay across the inductor, a proper physical arrangement would allow full operation because the proper phase delay is part of the simplest implementation. The antenna input impedance of the antenna will be nominally the same as the source impedance at the resonant frequency. Thus, the antenna has a low Voltage Standing Wave ratio (VSWR) when fed as a series circuit. Alternately, the antenna can be connected as a parallel resonant circuit and use either a tap for matching to the feed line or use a coupling loop.

An inductance is connected to the top cylinder and to the transmission line. The lower cylinder is connected to the coax shield, which is ground reference for this instance. For the purpose of discussion, assume the instantaneous phase of the RF signal is 0 degrees relative at the bottom of the inductor, thus the top cylinder is at 0 degrees, relative. The inductor is chosen to cause resonance at the desired frequency with the capacity between cylinders. The large voltage between the cylinders establishes an E field between cylinders. This can be referred to as the primary E field.

The voltage applied to the inductor from the feed line is much smaller that applied to the top cylinder, but is significant. Because the voltage at this point on the inductor is 90 degrees delayed relative to the voltage on the top cylinder, an E field is developed between that part of the inductor and the cylinders. This may be referred to as the secondary E field. Since this E field is 90 degrees delayed, the displacement current caused by this E field is advanced 90 degrees. Thus the resulting current is in phase with the primary E field. Because the H field is developed surrounding the E field, and both the primary E field and the secondary E fields are physically located in alignment, radiation develops.

Considering the magnitudes of the two fields, the ratio between the E and H fields must be the same as the impedance of free space (377 ohms). Because this antenna is an efficient radiator (and receiver), the ratio assumes its natural function causing the input impedance (resistance) at the resonant frequency to be nominally the same as the source impedance.

The only loss in the antenna system is the loss in the tuning inductor, which is very small if proper construction is used. Typically, the cylinders are made of copper or aluminum. Therefore, the effective terminating resistance is the radiation resistance. The bandwidth of the antenna is limited by the capacity of the cylinders. Due to their physical configuration, the capacity is small, thus the reactance is high. Typical Q is nominally 35 for small antennas according to the invention and operating in the HF spectrum. This compares to values of Q of about 30 for large Hertz dipoles which are physically 25 to 50 times larger in physical dimensions.

The impedance of the antenna is a function of the physical characteristics and frequency. Typically, the cylinders each have a length of 0.01% to 2.5% of a wavelength with length to diameter ratios of 1 to 6, dependent on the desired radiation pattern. The inductance is chosen to provide resonance at the desired frequency with the natural capacity between cylinders. The inductance is aligned coaxially with the cylinders.

Figure 5:
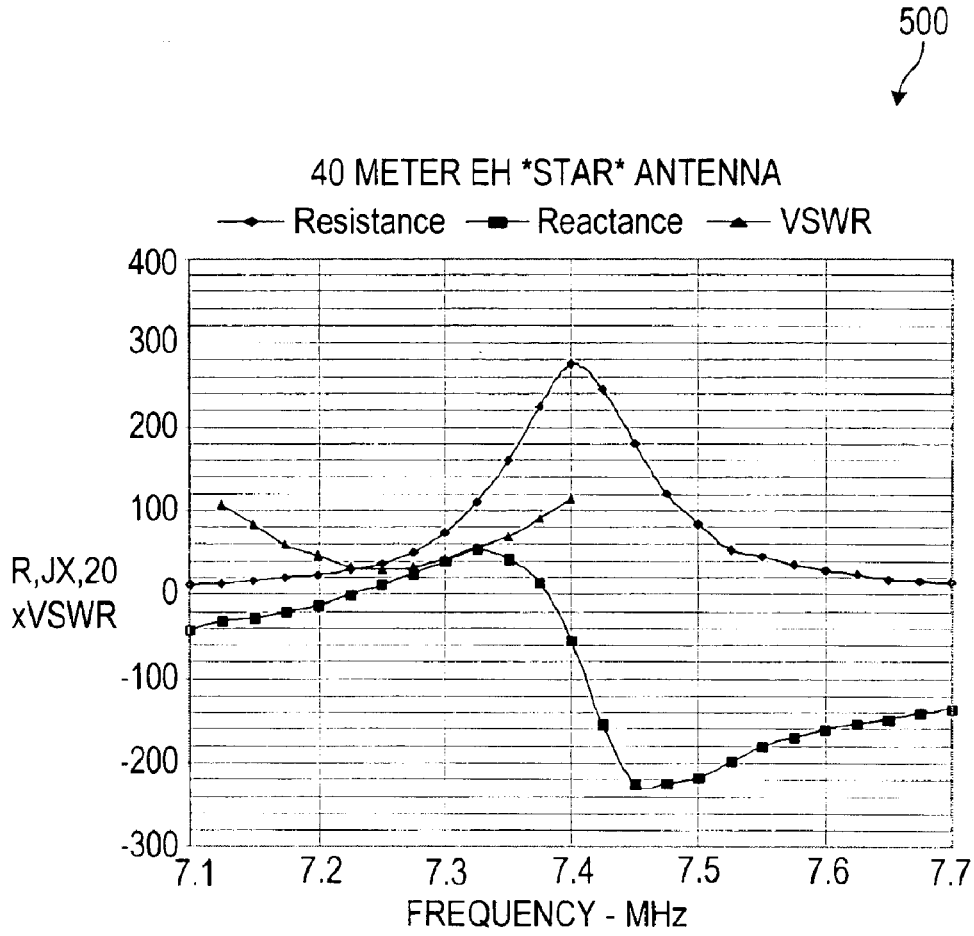
FIG. 5 is a chart showing performance parameters for one example of an antenna according to the invention.

A performance parameter chart 500 for one exemplary antenna according to the invention is shown in FIG. 5, which presents the impedance of this antenna as a function of frequency. The specific presentation is for an operating frequency near 7 MHz (the 40 meter Amateur Radio Band), but the shape of the curves is essentially the same at any frequency for which this type of EH Antenna is designed.

A VSWR curve relative to 50 ohms is presented to indicate one operating mode. A second mode is achieved when the source impedance is nominally 200 ohms. Both modes are at those frequencies where the reactance is near zero ohms. In either mode the radiation resistance of the antenna is high. The inductance can use a large wire to offer low loss resistance and there is very little resistance in the cylinders if they are made of high conductivity material such as aluminum or copper. Therefore, this antenna has exceptionally high efficiency, yet is a miniature antenna by conventional antenna standards.

Because radiation is created at the antenna, the E and H fields are contained in a volume not much larger than the dimensions of the antenna. This greatly reduces electromagnetic interference (EMI). When used as a receiving antenna, the reduced fields have a high rejection of E or H field noise, yet the capture of radiation equals that of conventionally-sized antennas. Therefore, the signal to noise ratio of the antenna is significantly higher than Hertz antennas.

Figure 6:
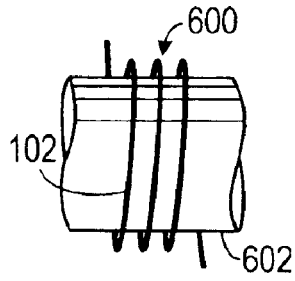
FIG. 6 is a schematic diagram of an RF choke.

The antenna of the invention can achieve optimum performance only if the transmission line feeding the antenna does not interfere. As shown in FIG. 6, this may be achieved by using a RF choke 600 in the feed line. For example, a few turns of a coaxial cable 102 over a ferrite rod 602 will offer a large effective reactance to currents on the external shield of the coaxial cable 102 without disturbing the currents internal to the coaxial cable 102. This allows the source (transmitter or receiver) to be properly coupled to the antenna.

The above-described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. An antenna system, for use with a signal cable having a signal lead and a common lead, comprising:

a. a first elongated dipole element;

b. a second elongated dipole element coupled to the common lead and spaced apart from the first elongated dipole element; and c. an inductor, spaced apart from the first elongated dipole element and the second elongated dipole element, and substantially coaxial with the first elongated dipole element and the second elongated dipole element, the inductor having a inductor proximal end and an inductor distal end, the inductor proximal end being electrically coupled to the signal lead and the inductor distal end being electrically coupled to the first elongated dipole element.

2. The antenna system of claim 1, wherein the second elongated dipole element is placed between the first elongated dipole element and the inductor so as to be coaxial with the first elongated dipole element and the inductor.

3. The antenna system of claim 1, further comprising a tube having an exterior surface, wherein the first elongated dipole element, the second elongated dipole element and the inductor are disposed about the exterior surface of the tube.

4. The antenna system of claim 3, wherein the tube comprises an insulator.

5. The antenna system of claim 4, wherein the insulator comprises polyvinyl chloride.

6. The antenna system of claim 1, further comprising a moveable contact that is electrically coupled to the signal lead and that electrically couples the signal lead to the inductor, the moveable contact being capable of coupling the signal lead to the inductor at a selected position of the inductor.

7. The antenna system of claim 1, wherein the first elongated dipole element comprises a conductive cylinder.

8. The antenna system of claim 1, wherein the second elongated dipole element comprises a conductive cylinder.

9. The antenna system of claim 1, wherein the inductor comprises a conductive coil.

10. The antenna system of claim 1, wherein the first elongated dipole element has a first diameter, the second elongated dipole element has a second diameter and the inductor each has a third diameter, and wherein the first diameter, the second diameter and the third diameter are essentially equal.

11. An antenna for use with a signal cable having a signal lead and a common lead, comprising:

a. an insulating elongated support member;

b. a first cylindrical conductor disposed about a first portion of the support member, the first cylindrical conductor having a proximal end and an opposite distal end;

c. a second cylindrical conductor disposed about a second portion of the support member and spaced apart from the first cylindrical member, the second cylindrical conductor having a proximal end and an opposite distal end, the proximal end in electrical communication with the common lead;

d. a conductive coil coiled about the elongated support member, spaced apart from and substantially coaxial with the first cylindrical conductor and the second cylindrical conductor, the conductive coil having a proximal end and an opposite distal end, the proximal end being in electrical communication with the signal lead and the distal end being in electrical communication with the proximal end of the first cylindrical conductor; and e. a moveable contact that is electrically coupled to the signal lead and that electrically couples the signal lead to the conductive coil, the moveable contact being capable of coupling the signal lead to the conductive coil at a selected position of the inductor so as to make the antenna tunable with respect to resonant frequency.

12. The antenna of claim 11, wherein the insulating elongated support member comprises a plastic tube.

13. The antenna of claim 11, wherein the first cylindrical conductor comprises metal foil.

14. The antenna of claim 11, wherein the second cylindrical conductor comprises metal foil.

15. A communications antenna for both transmitting and receiving in association with a communications system through a feed line having a high side and a ground, comprising:

a. two dipole elements that are short relative to a predetermined operating wavelength and that have a diameter so as to have a predetermined capacity therebetween;

b. an inductance, having a source end, disposed proximal to the two dipole elements, a first end of the inductance being electrically coupled to a first one of the two dipole elements; a second one of the two dipole elements being electrically coupled to the feed line, the high side of the feed line being connected to an end of the inductance opposite the source end, so that the predetermined capacity is resonated with an inductance and so that at a resonant frequency a large voltage forming a primary E field is developed between the two dipole elements and at the source end of the inductance a source voltage is 90 degrees delayed relative to the primary E field and so that the source voltage forms a secondary E field between the source end of the inductance and the two dipole elements and so that the secondary E field causes a displacement current to flow in a natural capacity of the space between the source end of the inductance and the dipole elements, such that the displacement current is advanced 90 degrees through the capacity so as to be in phase with the primary E field and develop a magnetic (H) field that surrounds the primary E field.

* * * * *